US007836801B2

(12) United States Patent
Huang

(10) Patent No.: US 7,836,801 B2
(45) Date of Patent: Nov. 23, 2010

(54) SCREWDRIVER BIT SET WITH IDENTIFICATION FUNCTIONS

(76) Inventor: Jui-Min Huang, No. 680, Dadun 12nd St., Nantun District, Taichung City (TW)

( * ) Notice: Subject to any disclaimer, the term of this patent is extended or adjusted under 35 U.S.C. 154(b) by 115 days.

(21) Appl. No.: 12/144,543

(22) Filed: Jun. 23, 2008

(65) Prior Publication Data

US 2009/0314142 A1 Dec. 24, 2009

(51) Int. Cl.
*B25B 23/00* (2006.01)

(52) U.S. Cl. ..... 81/177.1; 81/180.1; 81/184; 81/436; 81/DIG. 5; 40/913

(58) Field of Classification Search ..... 81/177.1, 81/488, 180.1, 184, 436–439, DIG. 5; 40/306, 40/913

See application file for complete search history.

(56) References Cited

U.S. PATENT DOCUMENTS 7,627,968 B2 * 12/2009 Lin ..... 40/306
2008/0034928 A1 * 2/2008 Sheu ..... 81/177.1

* cited by examiner

*Primary Examiner*—D. S Meislin
(74) *Attorney, Agent, or Firm*—Egbert Law Offices PLLC

(57) ABSTRACT

The present invention provides a screwdriver bit set with identification functions. Each bit body in the set has an insertion end, an actuating end and a neck portion. An aluminum alloy identification ring includes a trepan boring for assembly onto the neck portion of the bit body. The aluminum alloy identification ring also has an outer ring surface protruding from the neck portion of the bit body. An anodized protective film is formed on the surface of the aluminum alloy identification ring. The protective film presents bright color and a corrosion-resistant property, helping to prevent discoloring and provide durable identification effects with improved applicability.

1 Claim, 8 Drawing Sheets

SCREWDRIVER BIT SET WITH IDENTIFICATION FUNCTIONS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a screwdriver bit or drive bit, and more particularly to an innovative drive bit with identification functions.

2. Description of Related Art Including Information Disclosed Under 37 CFR 1.97 and 37 CFR 1.98

In a modern industrial society, a wide range of products can be fastened securely by screw bolts for application in the everyday life and at various work sites. Thus, screwdrivers are frequently used.

Owing to different dimensions of various screw bolts, a plurality of drive bit sets, comprising drive bits that can be flexibly inserted into the handle of the same screwdriver, is developed for operators.

Since multiple drive bit sets can be accommodated in any particular tool bit, identification of metric or English unit, or different dimensions is difficult. For this reason, a bit set with an identification mechanism has been developed. As for the typical structure of a drive bit, a colored ring portion is shaped at the neck of the drive bit by a coating pigment or a sleeved glue ring for identification purposes. However, it is found from actual application that, when this tool with coated pigment is held manually by the operator, the shedding and fading of the pigment may occur, leading to failure of identification. As for the tool with the sleeved glue ring, the glue is easily hardened and scratched, leading to shedding without identification functions.

Moreover, when the typical identification mechanism of the drive bit is used, a better identification effect may be achieved if the drive bit is view laterally. The identification mechanism is generally embedded into the neck of the bit, so this positioning makes identification difficult, when viewed from the end of the bit. As the drive bit set is often inserted vertically into the tool kit, the typical identification mechanism presents a poor identification effect for the operator.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

The drive bit of the present invention yields and identification effect through an anodized protective film formed on the surface of an aluminum alloy identification ring. The solid aluminum alloy resists deformation, and the protective film presents a bright color and corrosion-resistant property, allowing identification mechanism and preventing discoloration. The present invention provides a durable identification effect.

The outer ring surface of the aluminum alloy identification ring is protruded obviously from the neck portion of the bit body. The operator visualizes the identification easily from the end of the bit. The visualization angle is improved, substantially affecting the identification effect with improved applicability.

With the structural pattern of the aluminum alloy identification ring, it is possible to yield strong slip-resistance for the bit, allowing the operator to take or fetch the bit more easily and conveniently.

There are improvements brought about by this invention.

Based upon the structure of the present invention, an under-reaming portion is shaped on the trepan boring of the aluminum alloy identification ring close to its aperture. The aluminum alloy identification ring can be sleeved smoothly into the neck portion of the bit body. Moreover, when the aluminum alloy identification ring is tightly sleeved into the neck portion, the aluminum scraps generated will be pushed to one end and then collected in the interior space formed by the under-reaming portion, thus ensuring that the aluminum alloy identification ring is aesthetically pleasing.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
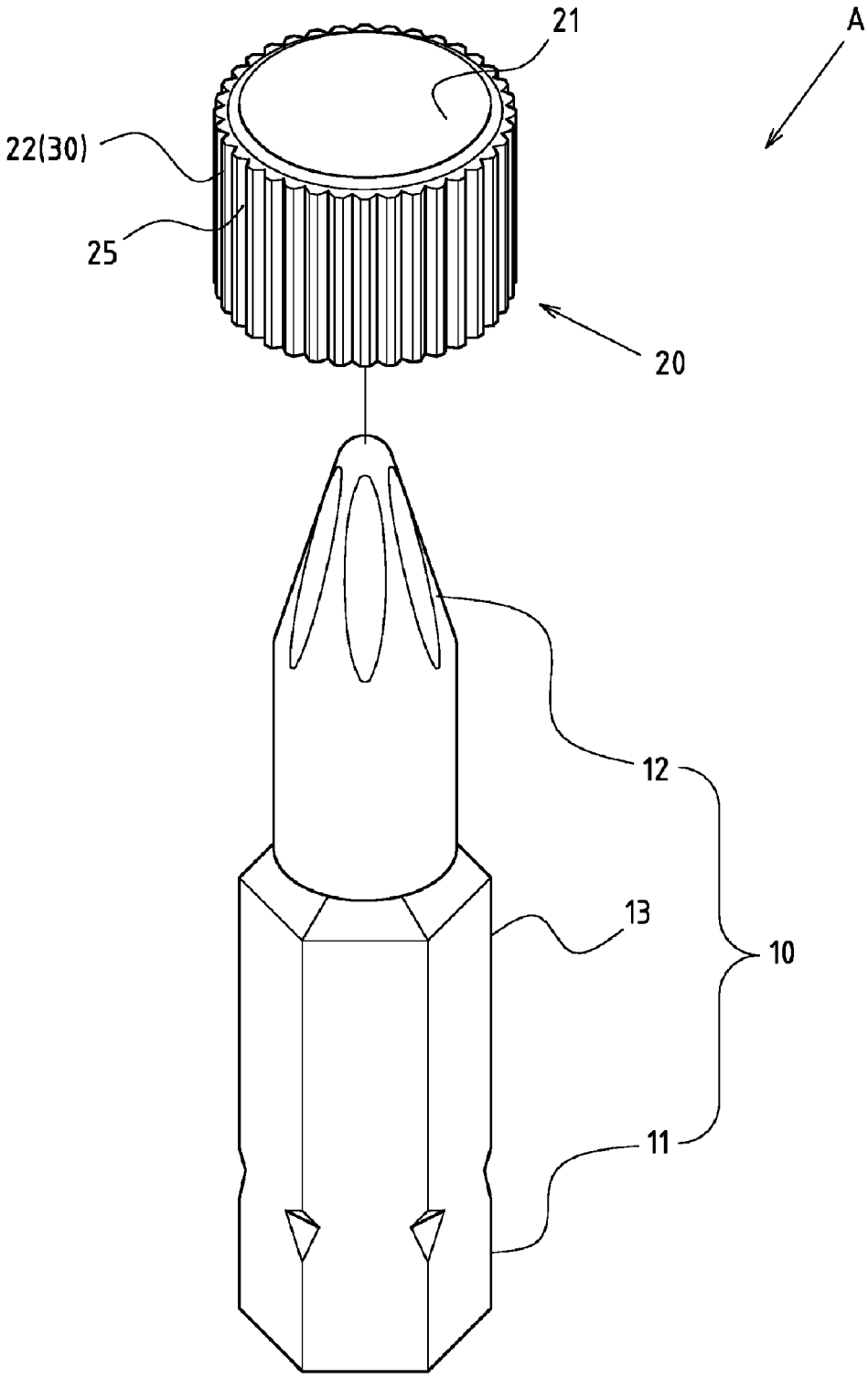
FIG. 1 depicts an exploded perspective view of the preferred embodiment of the present invention.
Figure 2:
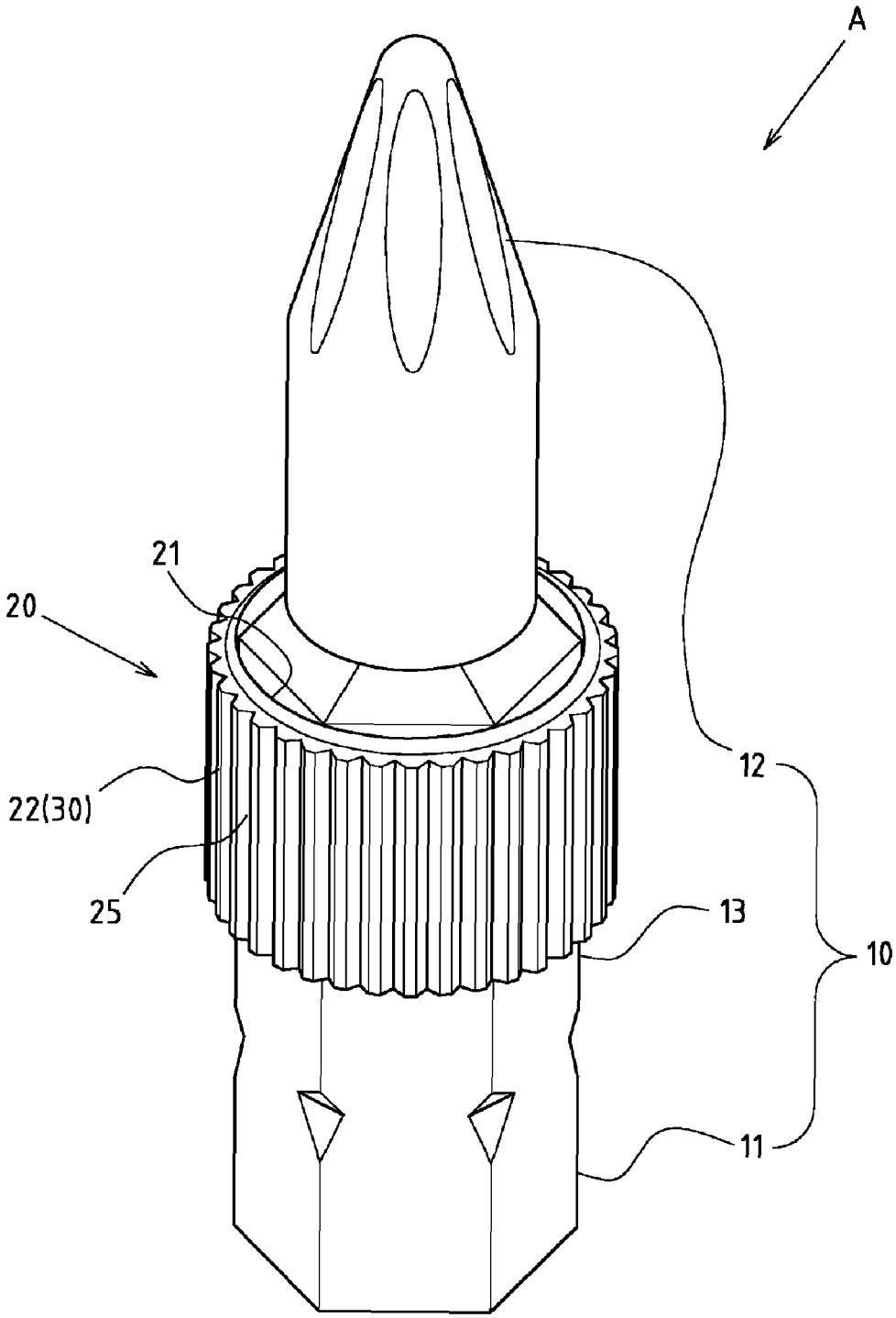
FIG. 2 depicts an assembled perspective view of the preferred embodiment of the present invention.
Figure 3:
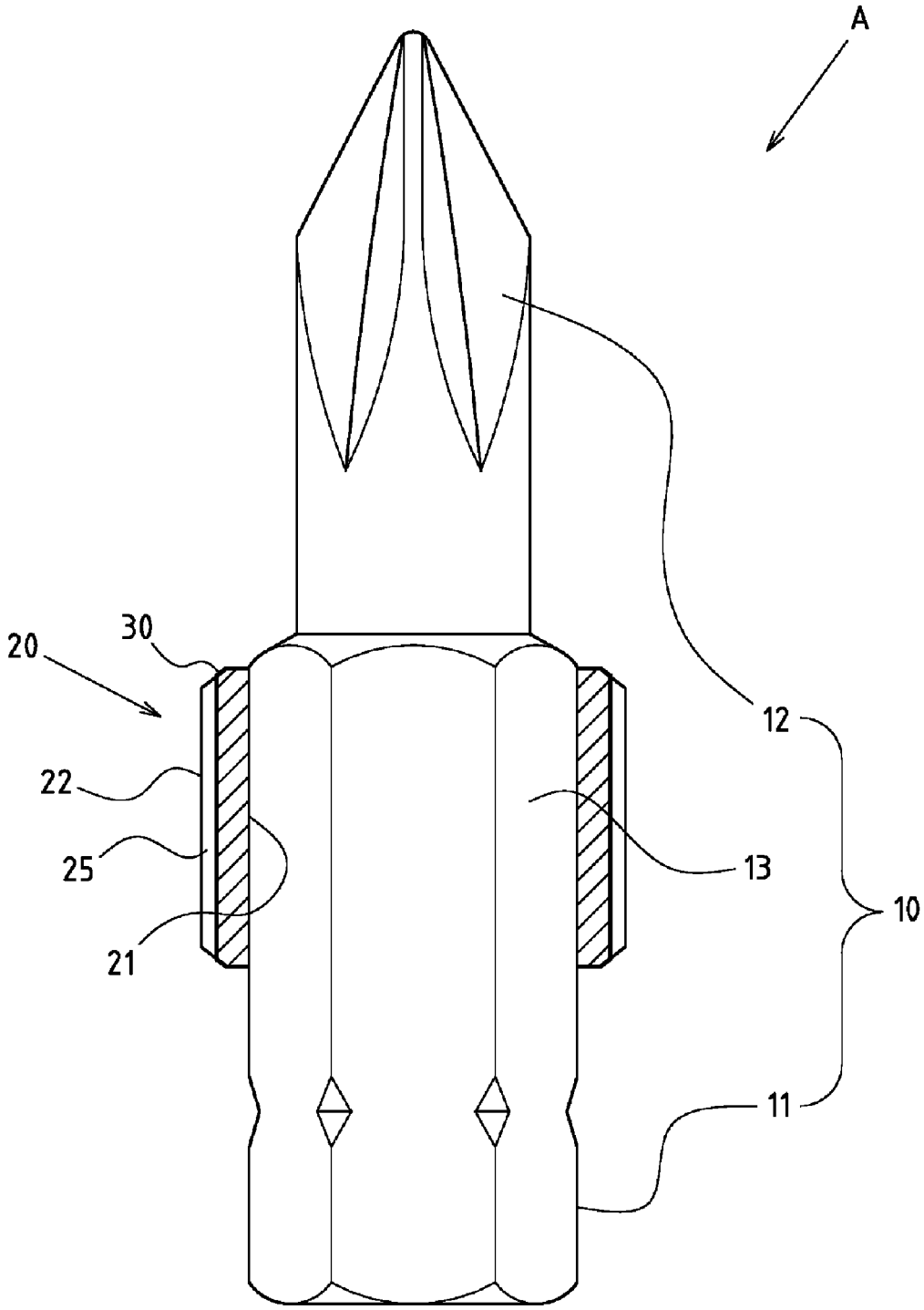
FIG. 3 depicts an assembled sectional view of the preferred embodiment of the present invention.

FIGS. 1-3 depict preferred embodiments of a drive bit set of the present invention with identification functions. The embodiments are provided only for explanatory purposes with respect to the patent claims.

The drive bit A comprises a bit body 10 with an insertion end 11, an actuating end 12 and a neck portion 13 between the insertion end 11 and actuating end 12.

An aluminum alloy identification ring 20 has a trepan boring 21 for assembly onto the neck portion 13 of the bit body 10. The aluminum alloy identification ring 20 also comprises an outer ring surface 22 protruding from the neck portion 13 of the bit body 10.

An anodized protective film 30 is formed on the surface of the aluminum alloy identification ring 20 as shown in FIG. 3. The protective film 30 helps to achieve identification and protection functions due to bright color and corrosion-resistant property.

Figure 4:
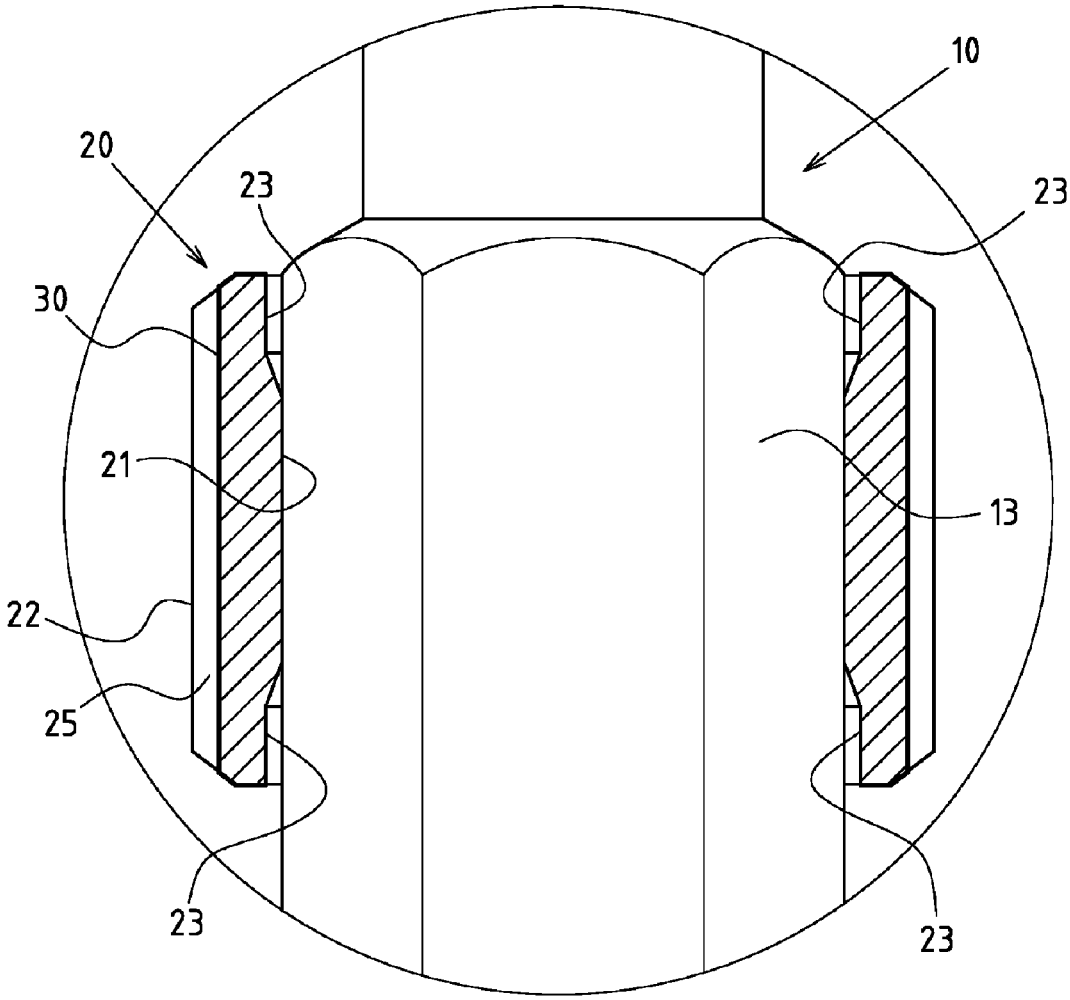
FIG. 4 depicts a sectional view of the application of the present invention, showing the aluminum alloy identification ring provided with an under-reaming portion.

Referring to FIG. 4, an under-reaming portion 23 is shaped on the trepan boring 21 of the aluminum alloy identification ring 20 close to its aperture. The under-reaming portion 23 is used to sleeve smoothly the aluminum alloy identification ring into the neck portion of the bit body. Moreover, if the aluminum alloy identification ring 20 has a cylindrical shape, and if the neck portion 13 of the bit body 10 has a hexagon shape, when the aluminum alloy identification ring 20 is tightly assembled into the neck portion 13, the wall of the trepan boring 21 may generate aluminum scraps due to strong friction. The aluminum scraps are pushed to one end and then collected in an interior space formed by the under-reaming portion 23, thus ensuring that aluminum alloy identification ring 20 is aesthetically pleasing.

Figure 5:
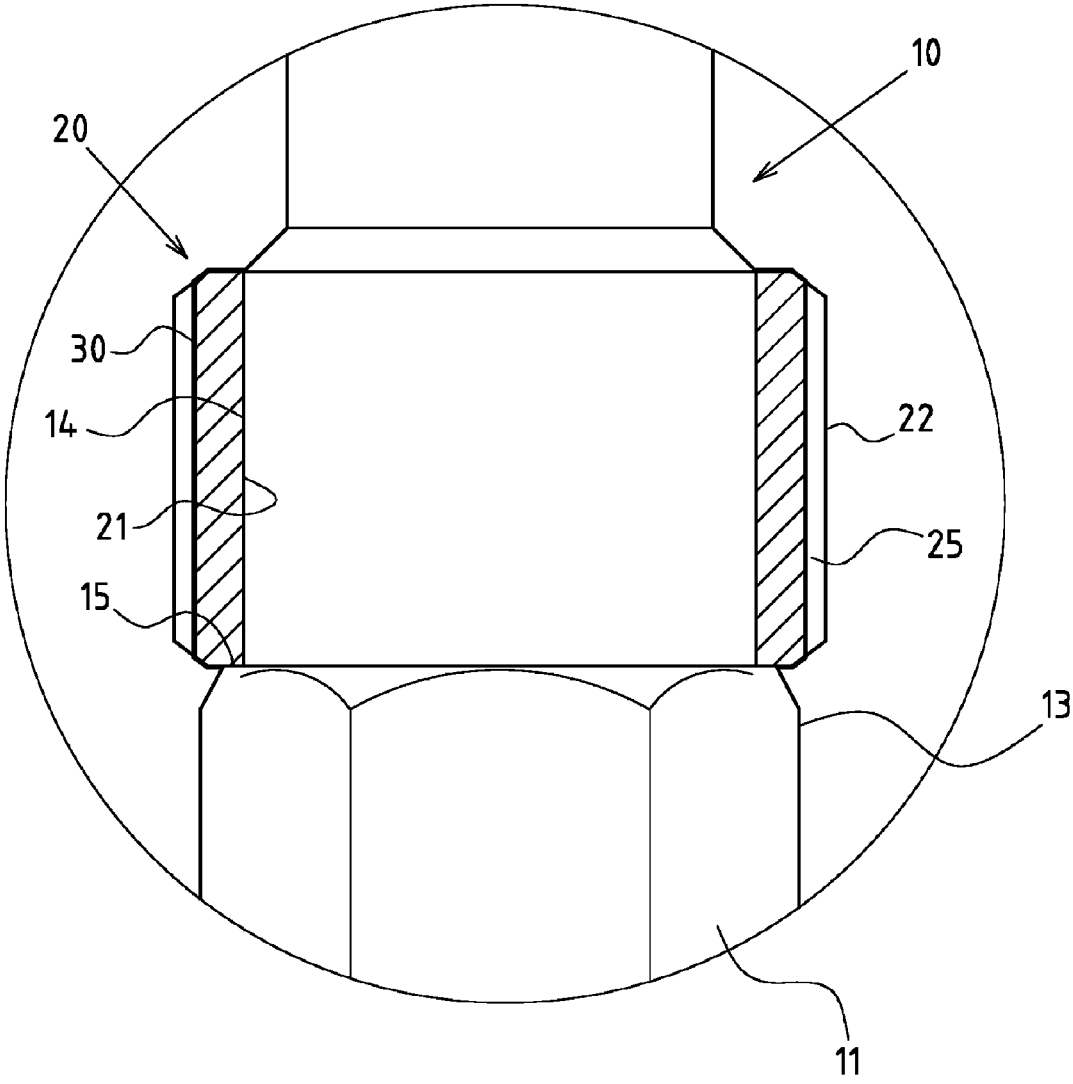
FIG. 5 depicts another sectional view of the application of the assembly of the aluminum alloy identification ring of the present invention.

Referring to FIG. 5, the neck portion 13 of the bit body 10 can be formed into a reducing section 14 which defines a stop flange 15. The trepan boring 21 of the aluminum alloy identification ring 20 can be sleeved onto the reducing section 14, and one end of the aluminum alloy identification ring 20 is abutted with the stop flange 15 for reliable positioning.

Figure 6:
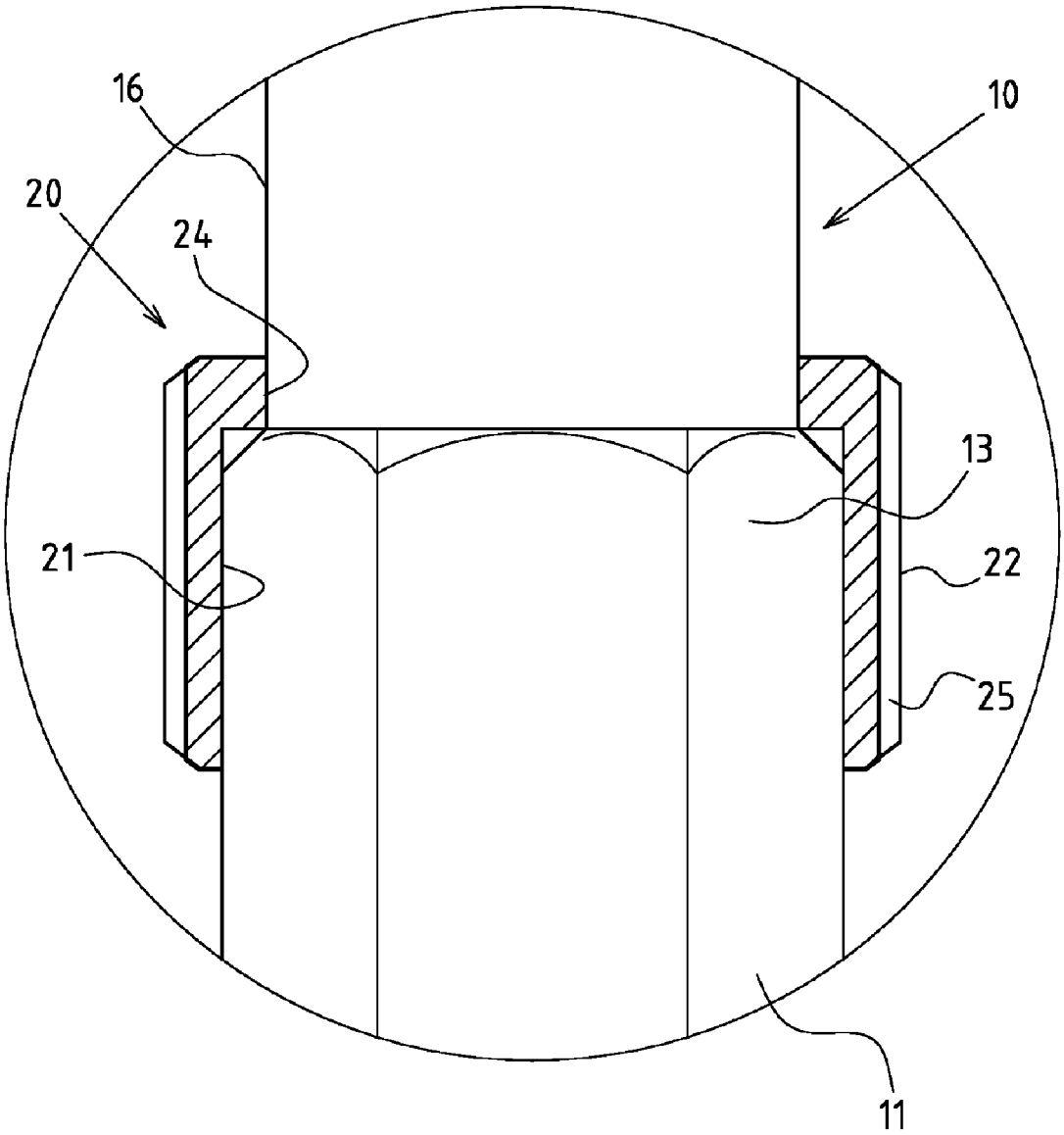
FIG. 6 depicts a sectional view of the application of the present invention, showing the aluminum alloy identification ring provided with a choke.

Referring to FIG. 6, a choke 24 is formed at an opening of the trepan boring 21 of the aluminum alloy identification ring 20, so that the neck portion 13 of the bit body 10 is provided with a reducing portion 16, which matches with the cross section of the choke 24. The cross section can be circular or hexagonal.

Figure 7:
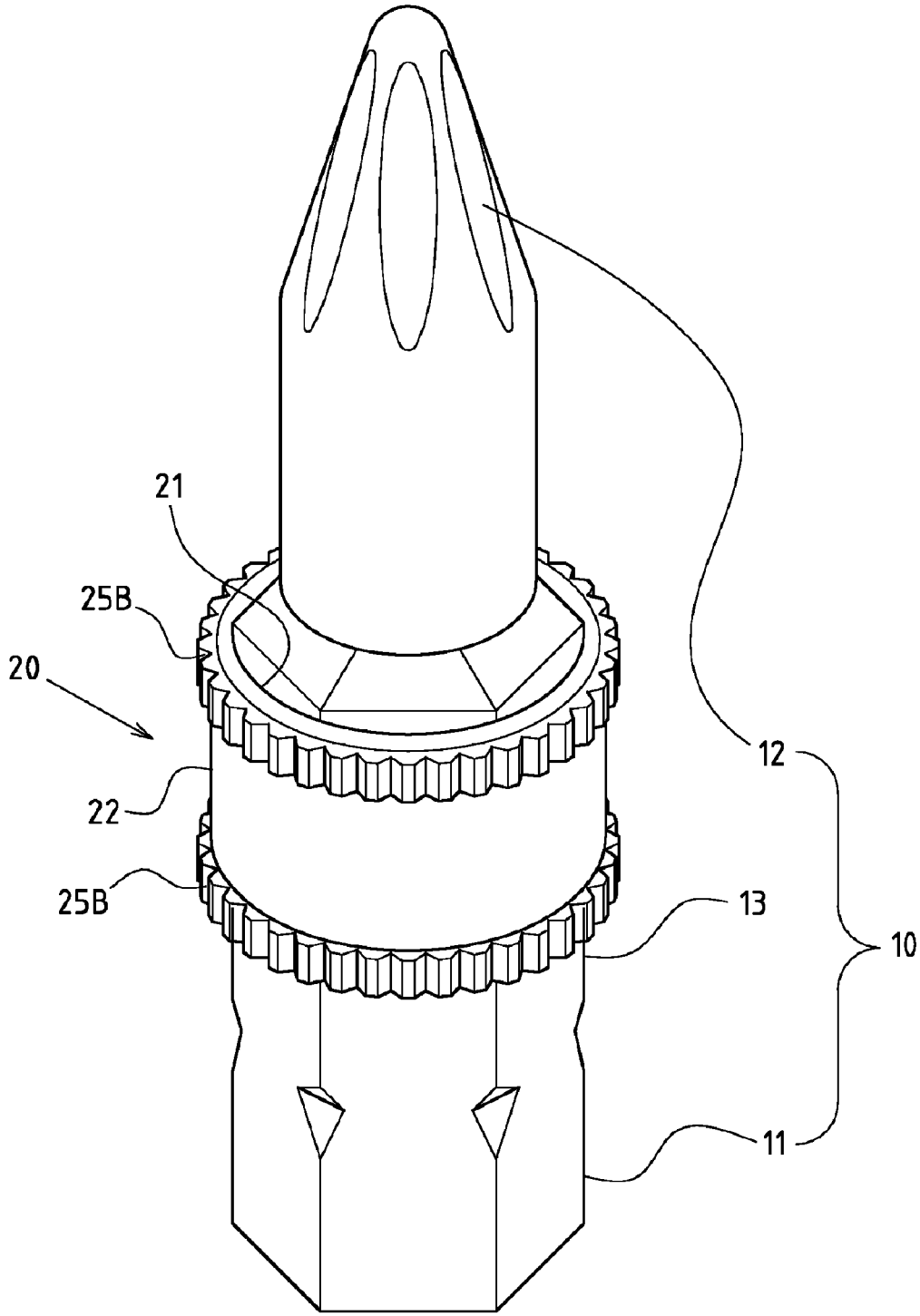
FIG. 7 depicts a perspective view of the anti-slip flange of the aluminum alloy identification ring.
Figure 8:
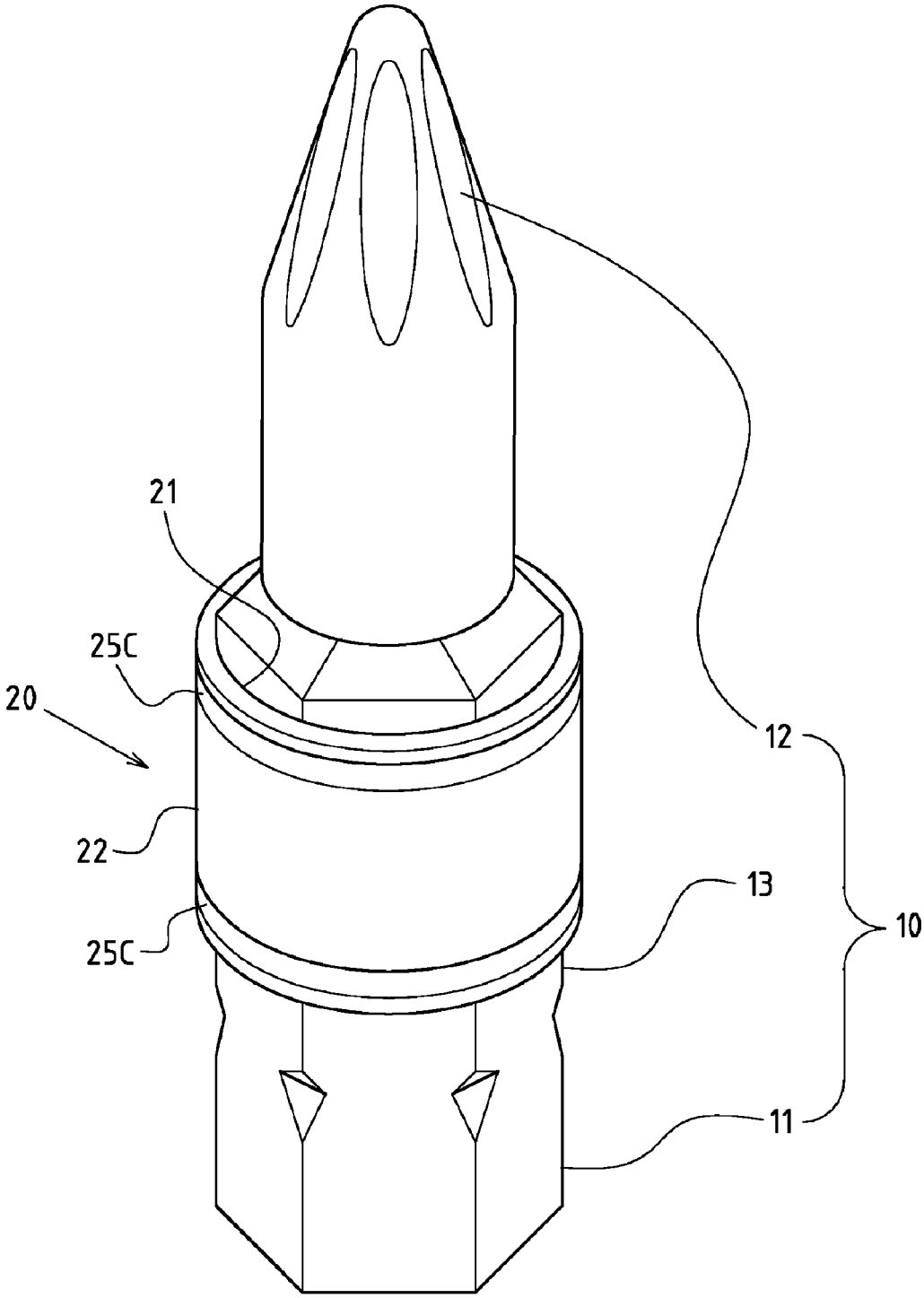
FIG. 8 depicts another perspective view of the anti-slip flange of the aluminum alloy identification ring.

An anti-slip flange 25 is shaped at the outer ring surface 22 of the aluminum alloy identification ring 20. The anti-slip flange 25 is available with several patterns. Referring to FIGS. 1-2, the anti-slip flange 25 is arranged axially into tooth ditches along the outer ring surface 22. Referring also to FIG. 7, the anti-slip flange 25B is arranged into the upper and lower tooth edges of the outer ring surface 22 of the aluminum alloy identification ring 20. Referring to FIG. 8, the anti-slip flange 25C is arranged into ring grooves of an outer ring surface 22 of the aluminum alloy identification ring 20. With the anti-slip flange, it is possible to improve the slip-resistance of the outer ring surface 22 of aluminum alloy identification ring 20, enabling the operator to hold it more reliably.

The trepan boring 21 of the aluminum alloy identification ring 20 could be tightly coupled with, or adhesively adapted with the neck portion 13 of the bit body 10.

Additionally, the aluminum alloy identification ring 20 of the present invention enables slip resistance for bit A. As existing bit sets are generally inserted vertically into the tool kit, and there is only a very limited spacing among them, the operator has to hold manually and apply force onto the bit rod, leading possibly to slippage and difficulty in operation. The aluminum alloy identification ring 20 of the present invention is designed in a manner that the outer ring surface 22 is protruded from the neck portion 13 of the bit body 10. The aluminum alloy identification ring 20 is of a solid metal structure, so it is possible to generate satisfactory slip-resistance for bit A.

I claim:

1. A bit assembly having an identification function, the bit assembly comprising:

a body having an insertion end and an actuating end with a neck portion extending between said actuating end and said insertion end, said neck portion having a polygonal cross-section;

an aluminum alloy identification ring having a circular boring extending therethrough, said ring affixed onto said neck portion of said bit body such that edges of said polygonal cross-section tightly embed with an inner wall of said ring, said ring having an outer ring surface protruding from said neck portion; and an anodized protective film formed on said outer ring surface of said ring, said protective film having a bright color, said protective film being corrosion-resistant.

* * * * *